US005271242A

United States Patent [19]

Addington

[11] Patent Number: 5,271,242

[45] Date of Patent: Dec. 21, 1993

[54] HEAT PUMP WITH HEAT EXCHANGER AIR INLET/EXHAUST DUCT

[75] Inventor: Robert R. Addington, Catlettsburg, Ky.

[73] Assignee: Consolidated Technology Corporation, Olive Hill, Ky.

[21] Appl. No.: 6,969

[22] Filed: Jan. 21, 1993

[51] Int. Cl.[5] ..... F25D 21/14

[52] U.S. Cl. ..... 62/285; 62/428; 62/259.1; 62/324.5; 62/324.1

[58] Field of Search ..... 62/428, 429, 259.1, 62/285, 288, 290, 324.1, 324.5

[56] References Cited

U.S. PATENT DOCUMENTS 4,424,686 1/1984 Lapeyre et al. ..... 62/259.1

*Primary Examiner*—John M. Sollecito

[57] ABSTRACT

A heat pump and method are provided whereby an interior heat pump having dual, vertically positioned condensor-evaporator compartments allows outside air to pass into an inlet passageway beneath the heat pump which communicates with the lower of said compartments. The outside air passes upwardly through an opening in the bottom of said lower compartment where it then passes through a condensor-evaporator and is directed by a centrifugal fan out another opening in the floor of the lower compartment. The inlet and outlet outside air passageways are slanted whereby any moisture collected therein will be drained away through a foundation wall.

4 Claims, 5 Drawing Sheets

HEAT PUMP WITH HEAT EXCHANGER AIR INLET/EXHAUST DUCT

BACKGROUND OF THE INVENTION

1. Field Of The Invention

The invention herein pertains to a heat pump for providing conditioned air for a building or other structure and particularly to a two-compartment heat pump with each compartment housing a condensor-evaporator, said heat pump positioned interiorly of the building.

2. Description Of The Prior Art And Objectives Of The Invention

Various interior heat pumps having vertical condensor-evaporator compartments have been commercialized in the past such as shown in U.S. Pat. No. 4,644,759. Various air flow configurations have been previously developed but the need for a convenient vertical two compartment heat pump configuration has been lacking which will allow outside air to both enter and exit the lower compartment through the floor for positioning in homes and other buildings having either crawl spaces or buildings constructed on concrete slabs. Moisture and the like present within heat pumps generally utilize housing condensation drains. However, oftentimes moisture collects on the floor of the heat pump and problems arise including metal corrosion, bacteria formation and the like which can cause health as well as mechanical problems.

With the aforesaid difficulties and disadvantages of conventional heat pumps, the present invention was conceived and one of its objectives is to provide a heat pump and method of operation whereby the heat pump has openings in the housing floor to allow outside air to both enter and exit therethrough.

It is another objective of the present invention to provide a heat pump and method which will allow convenient installation in either a crawl space or slab building construction.

It is still another objective of the present invention to provide a heat pump which will insure moisture drainage and outside air exhaust through the building foundation wall.

It is yet another objective of the present invention to provide a base which will firmly support the heat pump and will communicate with the openings in the floor of the lower compartment for the movement of outside air.

Various other objective and advantages of the present invention will become apparent to those skilled in the art as a more detailed description is set forth below.

SUMMARY OF THE INVENTION

The invention herein pertains to a two-compartment heat pump having a first, lower compartment for receiving and discharging outdoor air and an upper or second compartment disposed thereover for supplying conditioned air to the building. The heat pump housing includes front, rear, left side, right side, top and bottom walls. The bottom wall or floor in the first or lower compartment has a pair of openings therein whereby fresh outside air is delivered upwardly through one of the openings into the compartment, through a condensor-evaporator where it then passes through a centrifugal fan and is exhausted downwardly, through the second opening in the floor to an exhaust passageway to the outside. A heat pump base having a pair of parallel passageways allows the heat pump to be mounted thereon for a slab construction for equally efficient operation. The method of the invention includes directing fresh outside air upwardly through an opening in the floor of the lower compartment in the bottom of the heat pump, past a condensor-evaporator, through a fan also located in the lower compartment where the air is then exhausted through another floor opening of the lower compartment to a passageway which is biased to insure proper moisture drainage.

DESCRIPTION OF THE PREFERRED EMBODIMENT

Figure 1:
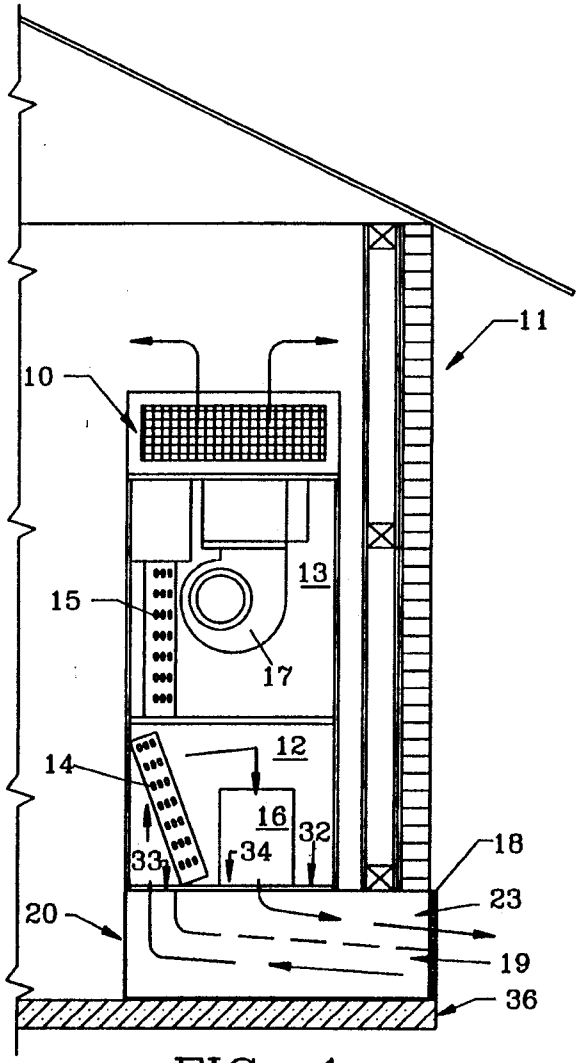
FIG. 1 shows a schematic view of a heat pump on a base of the invention mounted on a concrete slab of a typical building.

The preferred form of the invention is shown in FIG. 1 in which a vertical two-compartment heat pump having a housing consisting of a top, a bottom and four side walls is formed from sheet metal. A central panel separates the top and bottom compartments each of which contain a condensor-evaporator. A pair of openings in the lower compartment floor allows the entry and exhaust of outside air therethrough. The heat pump is mounted on a base on a concrete slab which includes a pair of parallel passageways which communicate between the openings in the lower compartment floor and a grate mounted on the outside foundation wall. A resilient seal of foam rubber or the like is disposed between the heat pump and the base. The preferred method of the invention consists of directing outside air into an inlet passageway, through an opening in the floor of the lower compartment of the heat pump, through a condensor-evaporator and then into a centrifugal fan which drives the air downwardly through a second opening in the lower compartment floor and out an exhaust passageway and through a foundation grate.

DETAILED DESCRIPTION OF THE DRAWINGS AND OPERATION OF THE INVENTION

Figure 2:
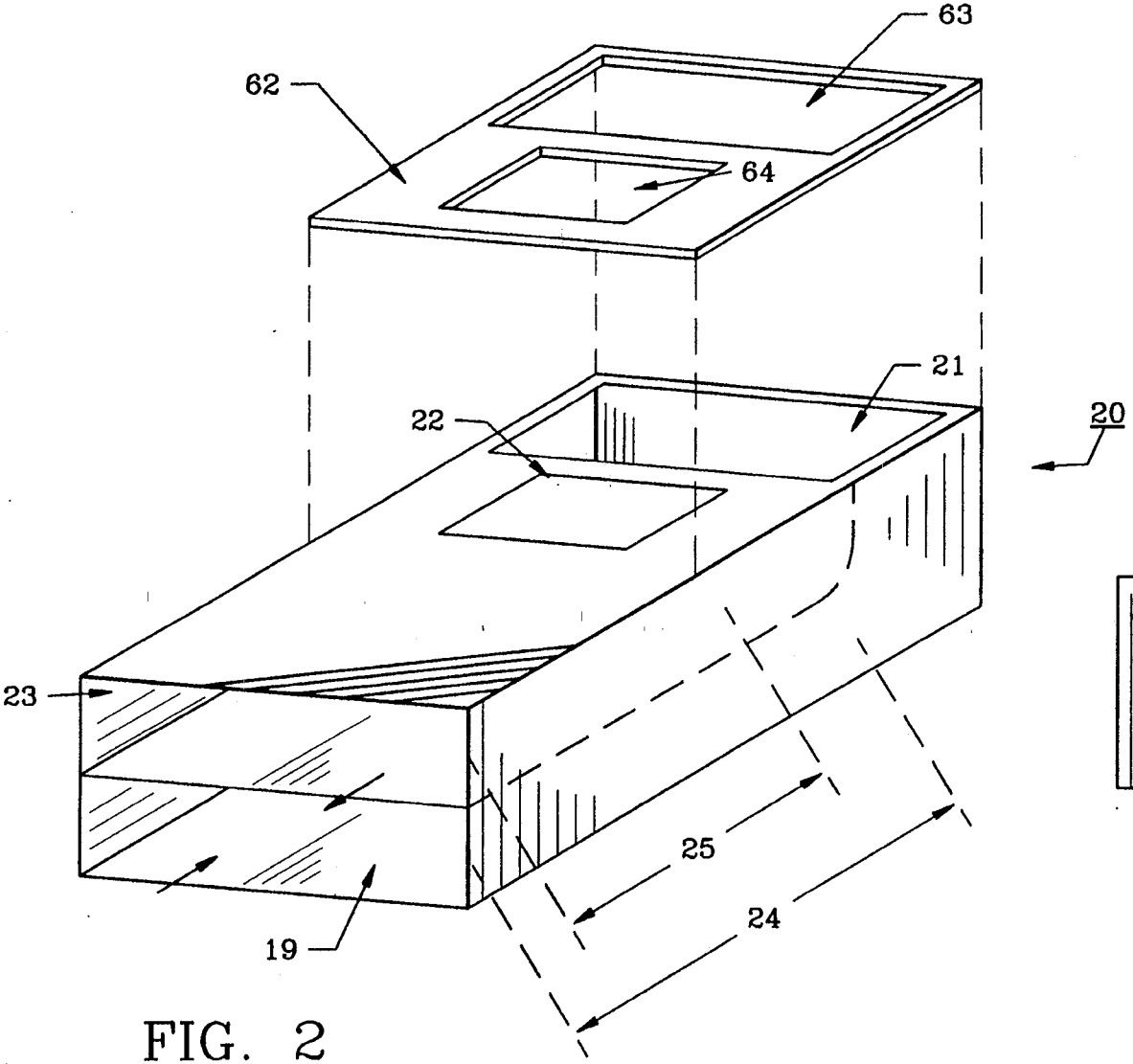
FIG. 2 illustrates an enlarged perspective view of the base as separated from the heat pump, as seen in FIG. 1 with a cellular foam seal exploded therefrom.

For a better understanding of the invention and its method of operation, turning now to the drawings, heat pump 10 is shown in FIG. 1 which is mounted interiorly of building 11 on concrete slab 36. Heat pump 10 includes top, front, rear, two sides and a bottom wall and with a lower or first compartment 12 and a second or upper compartment 13. Condensor-evaporators 14 and 15 are shown in first compartment 12 and second compartment 13, respectively. Floor 32 of first compartment 12 defines inlet opening 33 and exhaust opening 34. A resilient foam pad 62 having openings 63, 64 separate base 20 from heat pump 10 and forms a seal therebetween. Pad 62 is not shown in FIG. 1. Openings 63, 64 are sized to coincide with openings 33, 34 in floor 32 and with openings 21, 22 in base 20. As would be understood, condensor-evaporator 14 acts as a condensor during the cooling cycle of heat pump 10 and also acts as an evaporator during the heating cycle. Centrifugal fans 16, 17 direct air through, respectively first compartment 12 and second compartment 13. As shown, outside air moves through foundation grate 18 into inlet passageway 19 of heat pump base 20 (shown enlarged in FIG. 2), through inlet opening 21, through floor opening 33 past condensor-evaporator 14 and into centrifugal fan 16. The exhaust air then moves from fan 16 through first compartment floor opening 34, past exhaust opening 22, through exhaust passageway 23, and out grate 18. As further shown in FIG. 1, exhaust passageway 23 and outside air inlet passageway 19 are parallel and are biased along horizontal sections 24, 25 (FIG. 2) of respectively, inlet passageway 19 and exhaust passageway 23. Horizontal sections 24 and 25 are biased, i.e., slant downwardly towards foundation grate 18 in order to drain any moisture therein out foundation grate 18.

Figure 4:
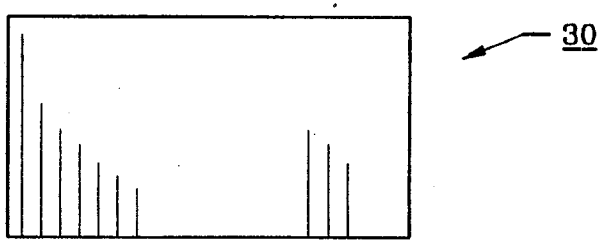
FIG. 4 demonstrates a rear view of the heat pump base as shown in FIG. 2.

Building 11 as shown in FIG. 1 may be a small house, office building or the like. Heat pump base 20 is seen in an enlarged rear view in FIG. 4 and provides a level posture of heat pump 10 positioned thereon while allowing drain to the outside of any moisture therein.

Figure 3:
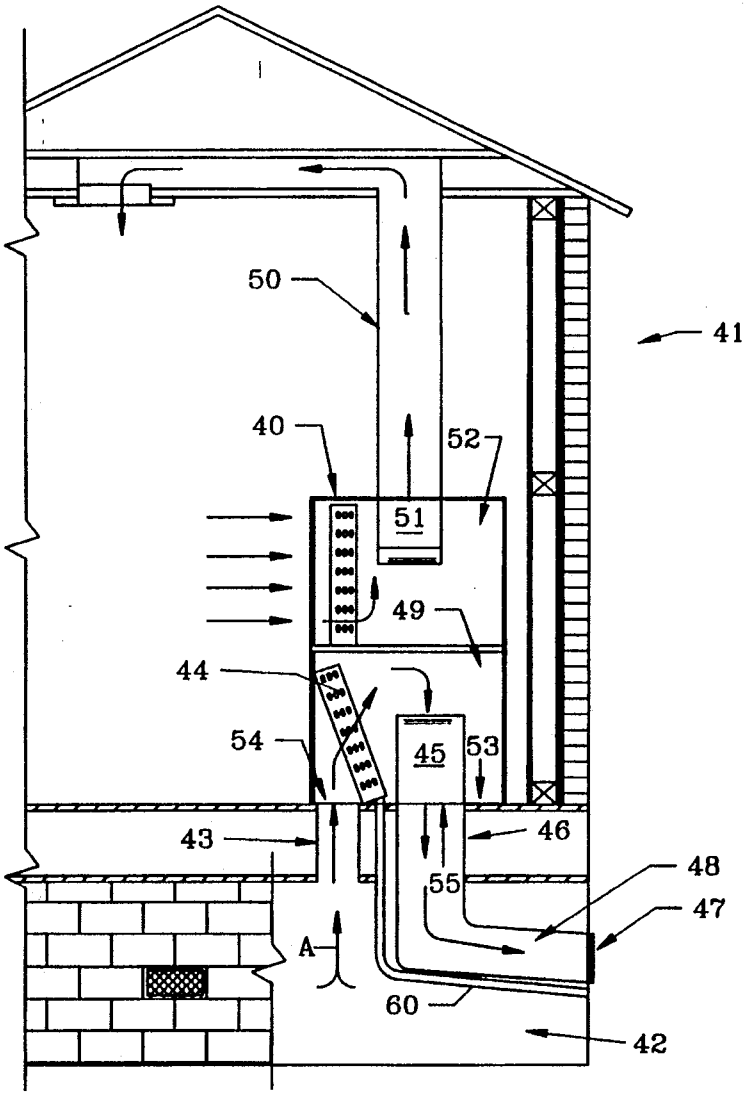
FIG. 3 demonstrates yet another heat pump of the invention which does not utilize the base of FIG. 2.

In FIG. 3 another embodiment or arrangement is shown whereby heat pump 40 is mounted interiorly of building 41 with outside air provided from building crawl space 42. Outside air "A" enters heat pump 40 through inlet passageway 43 where it passes through floor compartment inlet opening 54, through condensor-evaporator 44 and is then directed by fan 45 through compartment exhaust opening 55 in floor 53, into exhaust passageway 46 and out foundation grate 47. As shown, exhaust passageway 46 has a substantially horizontal section 48 which has a bias, or slant whereby any moisture therein will drain outwardly through grate 47.

The interior of building 41 is heated or cooled by conditioned air moving through air duct 50 which is driven by fan 51 in upper or second compartment 52 of heat pump 40 which is mounted vertically above first compartment 49. Condensation drain line 60 of heat pump 40 is also shown in FIG. 3 to allow continued removal of moisture collecting on condensor-evaporator 44.

Figure 5:
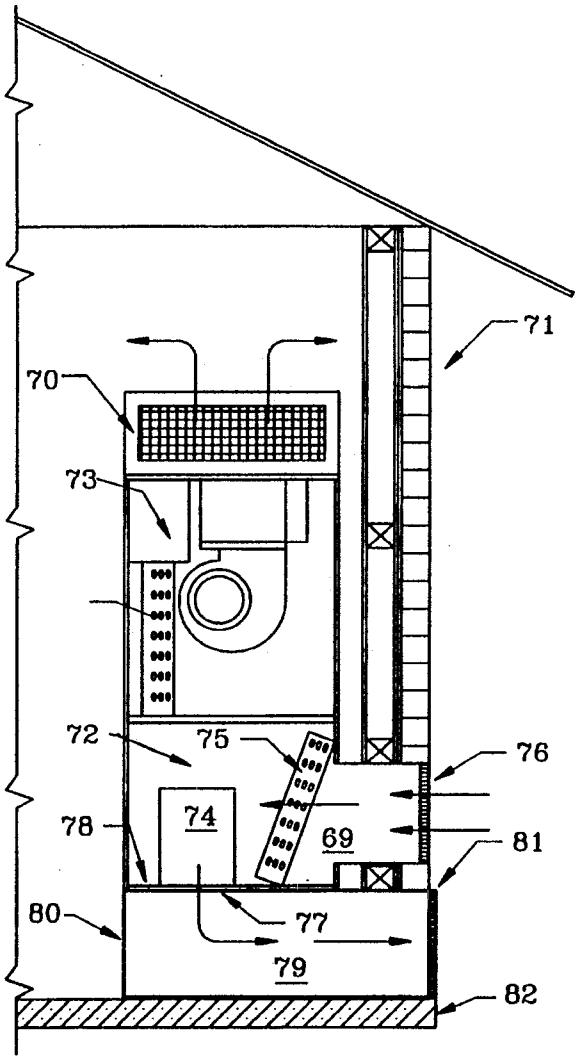
FIG. 5 pictures a heat pump having a side outside air entry configuration.
Figure 6:
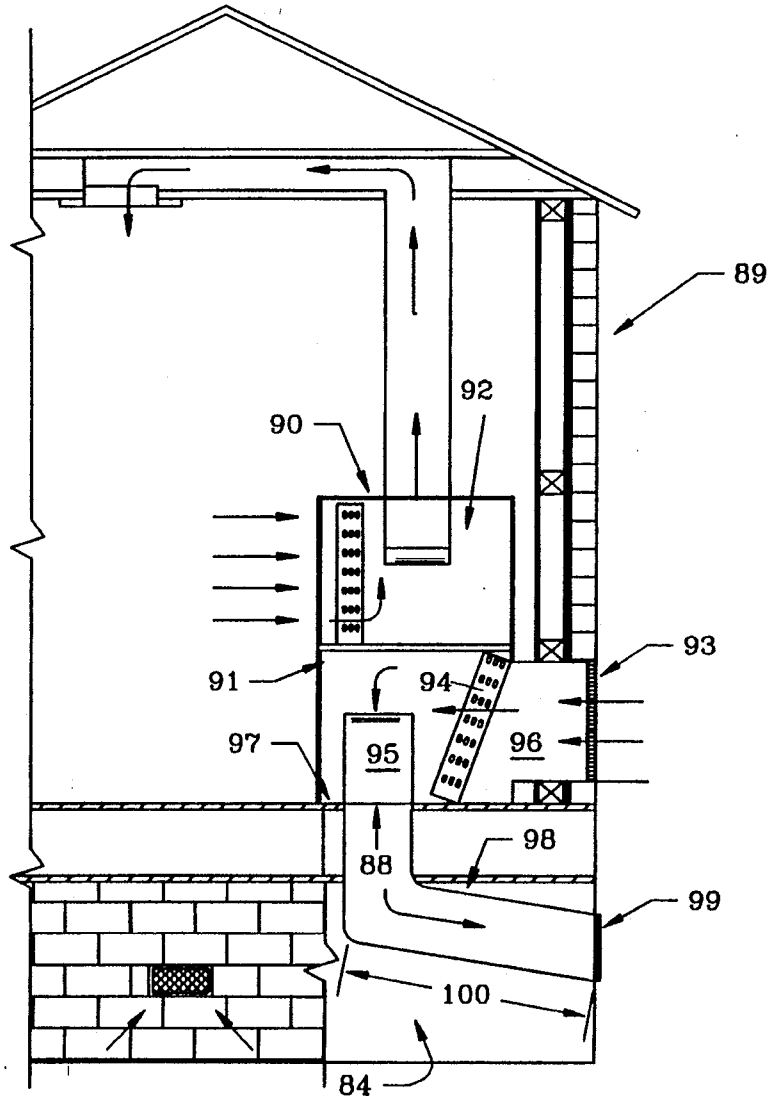
FIG. 6 illustrates a side entry design similar to FIG. 5 but positioned over a crawl space.

Another embodiment of the heat pump is shown in FIGS. 5 and 6 in which outside air is brought into the heat pump through the side wall of the building and is exhausted from the heat pump through the floor. As shown in FIG. 5, heat pump 70 is positioned in building 71 and contains a first compartment 72 and a second compartment 73 thereabove. Lower compartment 72 houses centrifugal fan and condensor-evaporator 75 and as shown, outside air enters through side wall vent cover 76, and into horizontal inlet passageway 69 where it passes through condensor-evaporator 75, through centrifugal fan 74 and is exhausted through opening 77 in housing floor 78. The exhaust air then travels through single passageway base 80 and through grate 81 to the outside. Base 80 positioned on slab 82 is similar to base 20 in FIG. 2 but includes only a single exhaust passageway 79 for the exhaust air to move and as shown, is a rectangular configuration with only one opening 77 but could include baffles or the like to improve the air flow if required. A foam pad (not shown) is positioned between floor 78 and base 80. Thus as seen, air enters and is exhausted substantially parallel in horizontal flow paths.

In FIG. 6 heat pump 90 is shown mounted in building 89 having a crawl space 84. Heat pump 90 has a first compartment 91 into which outside air passes from side wall vent cover 93, into horizontal inlet passageway 96, into condensor-evaporator 94, and through centrifugal fan 95 where it is exhausted through floor opening 88 in first compartment housing floor 97 where it then passes through exhaust passageway 98 within crawl space 84 and to the outside through exhaust grate 99. As seen exhaust passageway 98 is biased to drain any collected moisture therein and has a short section 100 which is somewhat horizontal.

In the schematic embodiments of the heat pumps shown, all the necessary conventional components of operation are not included. In FIGS. 1 and 3, the method of supplying outside air to a compartment of the particular heat pump includes directing outside air through an opening in the floor of the lower of said compartments and past a condensor-evaporator. (Said heat pumps have condensor-evaporators in both compartments and use centrifugal fans.) Thereafter the air is exhausted through an opening in the lower compartment floor to an exhaust passageway having a biased horizontal section to an outside foundation wall.

The illustrations and examples provided herein are for explanatory purposes and are not intended to limit the scope of the appended claims.

I claim:

1. In a two compartment, interior heat pump in which each compartment houses a condensor-evaporator, the first of said compartments housing a condensor-evaporator which acts as a condensor during the cooling cycle and the second said compartment housing a condensor-evaporator which acts as an evaporator during the cooling cycle, said first compartment having a housing floor, the improvement comprising: said housing floor defining first and second openings, a base positioned below and in mating relationship to said floor, said base comprising an exhaust and an inlet passageway, said base provides structural support for said heat pump, said exhaust passageway communicating with said first housing compartment floor opening, said inlet passageway communicating with said second housing floor opening, said inlet and said exhaust passageways each having a horizontal section.

2. The heat pump of claim 1 wherein said exhaust passageway is biased to drain moisture from said heat pump.

3. The heat pump of claim 2 wherein said base is rectangularly shaped.

4. The heat pump of claim 3 wherein said inlet passageway is parallel to said exhaust passageway and said inlet passageway extends beyond said exhaust passage.

* * * * *